US008951133B2

(12) United States Patent
Leach

(10) Patent No.: US 8,951,133 B2
(45) Date of Patent: Feb. 10, 2015

(54) WATERSLIDE KALEIDOSCOPE AMUSEMENT DEVICE

(71) Applicant: Timothy Thor Leach, Westminster, CO (US)

(72) Inventor: Timothy Thor Leach, Westminster, CO (US)

(73) Assignee: Timothy Thor Leach, Berthoud, CO (US)

( * ) Notice: Subject to any disclaimer, the term of this patent is extended or adjusted under 35 U.S.C. 154(b) by 104 days.

(21) Appl. No.: 13/860,106

(22) Filed: Apr. 10, 2013

(65) Prior Publication Data

US 2014/0309049 A1 Oct. 16, 2014

(51) Int. Cl.
*A63G 21/18* (2006.01)
*A63G 21/00* (2006.01)

(52) U.S. Cl.
CPC ..... *A63G 21/18* (2013.01)
USPC ..... 472/117; 472/61

(58) Field of Classification Search
USPC ..... 472/13, 116, 117, 128, 72, 61; 104/69, 104/70
See application file for complete search history.

(56) References Cited

U.S. PATENT DOCUMENTS

| | | | | |
|---|---|---|---|---|
| 4,725,135 | A * | 2/1988 | Browning | 353/122 |
| 5,482,510 | A * | 1/1996 | Ishii et al. | 472/61 |
| 7,591,108 | B2 * | 9/2009 | Tuczek | 52/80.1 |
| 7,738,172 | B2 * | 6/2010 | McGuire, Jr. | 359/489.01 |
| 7,967,692 | B2 * | 6/2011 | Werner | 472/117 |

* cited by examiner

*Primary Examiner* — Kien Nguyen

(57) ABSTRACT

A waterslide kaleidoscope amusement device consisting of straight or curved modules that can be used singly or connected in series and utilize two or more internal reflective surfaces and light source (s) to create an optical experience for the user. The device consists of a transparent watercourse slide tube surrounded by two or more reflective surfaces and illuminated in such a way that objects and light sources within the modules are reflected in a kaleidoscopic fashion from the visual perspective of the user.

3 Claims, 2 Drawing Sheets

WATERSLIDE KALEIDOSCOPE AMUSEMENT DEVICE

TECHNICAL FIELD

This invention relates to waterslides and more specifically to an enclosed waterslide or section of waterslide surrounded by two or more reflective surfaces and illuminated to create a kaleidoscopic visual experience for the user.

BACKGROUND INFORMATION

Waterslides generally have a slide that is comprised of one or more pieces of material creating an inclined water conveying course that forms a path extending from an upper end to a lower end and over which an individual may travel. The upper end of the slide is where a user enters the slide and the lower end is where a user exits the slide.

Typical watersides will follow a course that continually changes direction in a looping, sinuous manner by using a combination of straight, curved and helical sections. These changes in direction enhance the amusement value of the ride by repeatedly stimulating the user's vestibular and kinesthetic senses. Many waterslides also incorporate covered portions of slide that immerse the user in either relative or total darkness and are made from colored and/or polished materials that are intended to engage the user's visual sense and thereby further increase the associated amusement value.

SUMMARY OF THE INVENTION

It is therefore an object of the present invention to provide a waterslide kaleidoscope amusement device that is comprised of: (a) a transparent watercourse slide tube, (b) two or more inward facing reflective surfaces, and (c) a source of illumination. The transparent watercourse slide tube should be composed of a tough, high strength, low friction material. The slide tube can be either colored or colorless and preferably, though not necessarily, of a low refractive index. The inward facing reflective surfaces should number two or more and be arranged in an edge-to-edge configuration surrounding the slide tube's long axis. The internal illumination can be of either a natural or artificial nature and must provide enough light in the visual spectrum for the user to see both the light source and reflections of said source.

The visual experience of the user can be increased further by modifying the visual properties of any of the three active device components (slide tube, reflective surface and/or illumination) either within the length of a single module or from one module to the next when the modules are placed in series.

DESCRIPTION OF PREFERRED EMBODIMENTS

It is therefore an object of the present invention to provide a waterslide kaleidoscope amusement device that incorporates a transparent watercourse slide tube, inward facing reflective surfaces and a source of illumination sufficient so that a user can see both the source of illumination and the reflections of said source in said inward facing reflective surfaces so as to stimulate the user's visual sense as the user passes through the device from one end to another and thereby increase the associated amusement value.

Figure 1:
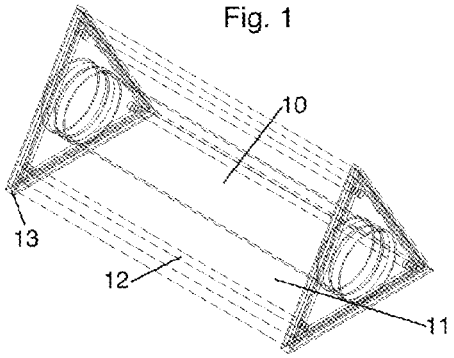
FIG. 1 is an isometric view of a waterslide kaleidoscope amusement device module of the present invention showing a transparent watercourse slide tube surrounded by three reflective surfaces and containing three light sources supported by structural elements at each end.
Figure 2:
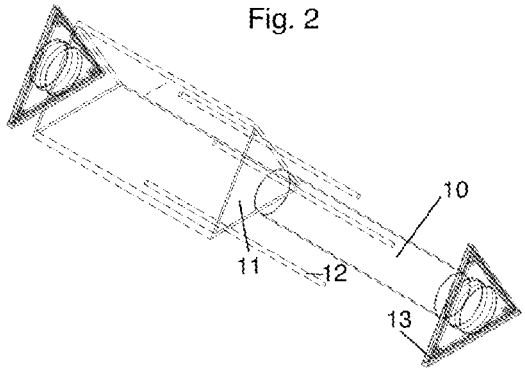
FIG. 2 is an exploded isometric view of a waterslide kaleidoscope amusement device module of the present invention illustrating all elements shown in FIG. 1 in a non-functional arrangement.
Figure 3:
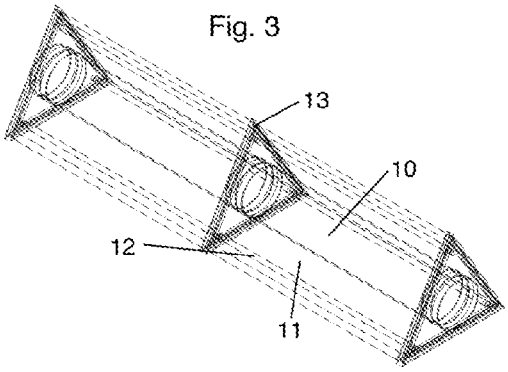
FIG. 3 is an isometric view of two waterslide kaleidoscope amusement device modules connected together in an end-to-end relationship.
Figure 4:
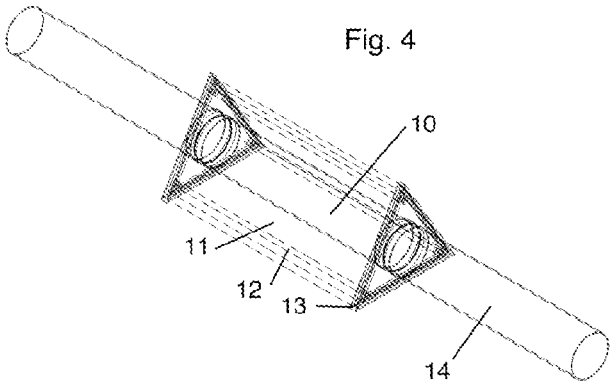
FIG. 4 is an isometric view of a single waterslide kaleidoscope amusement device module connected in an end-to-end relationship with two conventional enclosed waterslide segments.

FIGS. 1 and 2 illustrate one possible configuration of a waterslide kaleidoscope amusement device, which includes a transparent watercourse slide tube 10, inward facing reflective surfaces 11, and sources of illumination 12. The slide tube, surfaces and illumination are supported by structural elements 13 placed at each end of the module. These structural elements 13 serve not only to separate and support other device elements, but are also rigid mounting points for the waterslide's supporting framework (not shown). Said structural elements 13 can also act as connectors and adaptors joining separate modular sections of the present invention to each other (as depicted in FIG. 3) or to sections of conventional waterslide (as depicted in FIG. 4).

Figure 5:
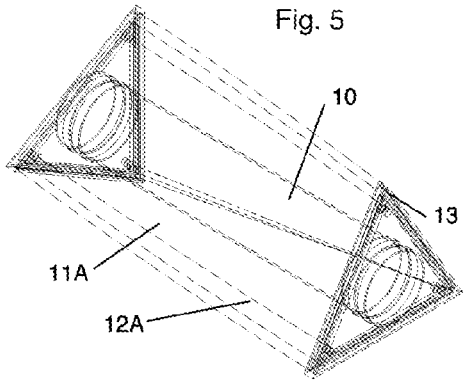
FIG. 5 is in isometric view of a waterslide kaleidoscope amusement device module in which the reflective surfaces are configured in a twisting spiral around a transparent watercourse slide tube's long axis.
Figure 6:
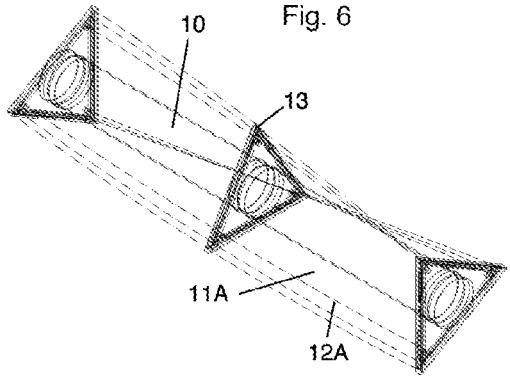
FIG. 6 is an isometric view of two waterslide kaleidoscope amusement device modules with twisting reflective surfaces connected together in an end-to-end relationship.

FIGS. 5 and 6 illustrate a configuration of the present invention wherein the inward facing reflective surfaces 11A are configured in such a way that said surfaces twist around said watercourse slide tube's long axis. A user will see reflections twist around his or her visual perspective as they travel through the device. In FIG. 6, two twisted waterslide kaleidoscope amusement device modules are connected together in an end-to-end relationship so that the slope of the twist is continued from one module to the next.

Figure 7:
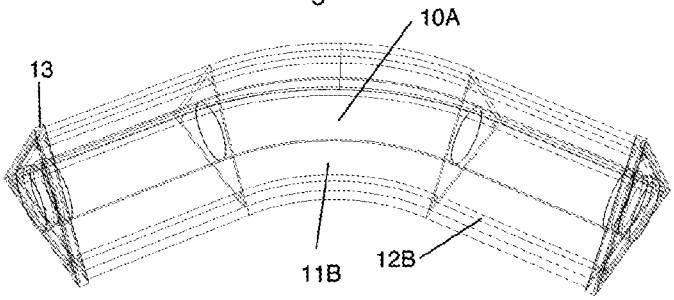
FIG. 7 is an isometric view of a curved waterslide kaleidoscope amusement device module.

Another possible configuration of the present invention is depicted in FIG. 7 where the watercourse slide tube 10A is curved. Reflective surfaces 11B and sources of illumination 12B are so constructed as to follow the slide tube's path resulting in a curved module that will change the path taken by the user. The angle of the curved module can be whatever angle is necessary as long as the diameter of the curve is sufficient to prevent injury to the user.

Figure 8:
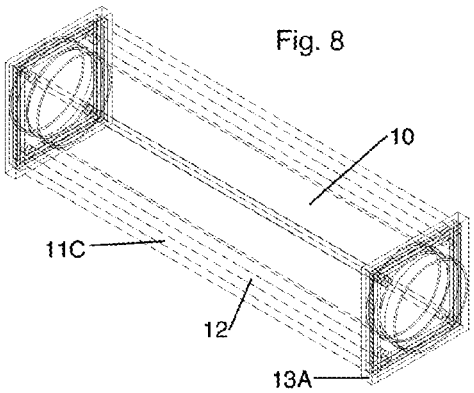
FIG. 8 is an isometric view of a waterslide kaleidoscope amusement device module incorporating four reflective surfaces.

The configuration of the present invention featured in FIG. 8 utilizes the same transparent slide tube and sources of illumination as in FIG. 1 but with modified structural elements 13A designed to accommodate the addition of a fourth inward facing reflective surface 11C. Any configuration of two or more reflective surfaces may be used in the apparatus of the present invention and each of those configurations will result in a varied visual experience for the user.

Figure 9:
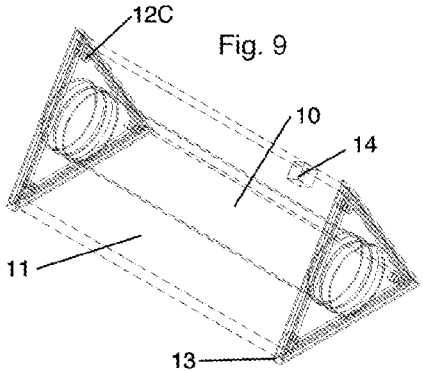
FIG. 9 is an isometric view of a waterslide kaleidoscope amusement device module containing six small independently controllable light sources.

FIG. 9 illustrates a configuration of the present invention in which the type and placement of sources of illumination 12C differ from FIG. 1. FIG. 9 depicts six independent sources of illumination that are controllable and programmable via a controller 14 and can be made to vary over time in color and intensity, three at each end of the module mounted on the structural elements 13. Variations in the intensity and color of illumination will result in a more varied visual experience for the user and will thereby increase the associated amusement value of the present invention.

Various changes and modifications may be made to the apparatus of the present invention without departing from the spirit and scope of the present invention as recited in the appended claims and their legal equivalent.

What is claimed is:

1. A waterslide kaleidoscope amusement device comprising:

A straight or curved transparent watercourse slide tube;

A series of two or more inward facing reflective surfaces arranged edge-to-edge around said transparent watercourse slide tube's long axis;

A source of illumination in the visual spectrum providing sufficient light for the user to see both said source of illumination and reflections of said source of illumination in said reflective surfaces.

2. A waterslide kaleidoscope amusement device, as claimed in claim 1, wherein:

Said inward facing reflective surfaces are configured in such a way that they twist around said transparent watercourse slide's long axis.

3. A waterslide kaleidoscope amusement device, as claimed in claim 1, further comprising:

A controller capable of causing changes over time in intensity and/or color of said source of illumination.

* * * * *